US006823529B1

(12) United States Patent
Dako

(10) Patent No.: US 6,823,529 B1
(45) Date of Patent: Nov. 30, 2004

(54) PROTECTIVE WAISTCOAT

(75) Inventor: Kwame Dako, Kobenhavn N (DK)

(73) Assignee: Shapes, Kobenhavn N (DK)

( * ) Notice: Subject to any disclaimer, the term of this patent is extended or adjusted under 35 U.S.C. 154(b) by 86 days.

(21) Appl. No.: 10/030,957

(22) PCT Filed: Jul. 7, 2000

(86) PCT No.: PCT/US00/18588

§ 371 (c)(1),
(2), (4) Date: May 21, 2002

(87) PCT Pub. No.: WO01/04562

PCT Pub. Date: Jan. 18, 2001

(30) Foreign Application Priority Data

Jul. 18, 1999 (DK) ..... 1999 00990
Feb. 15, 2000 (DK) ..... 2000 00238
May 1, 2000 (DK) ..... 2000 00710

(51) Int. Cl.[7] ..... F41H 1/04
(52) U.S. Cl. ..... 2/2.5
(58) Field of Search ..... 2/2.5, 102, 96, 2/97, 94, 247, 462, 464, 467; 89/36.01, 36.02, 36.05; 428/911

(56) References Cited

U.S. PATENT DOCUMENTS 3,557,384 A * 1/1971 Barron et al. ..... 2/2.5
3,803,639 A * 4/1974 Cohen ..... 2/2.5
3,973,275 A * 8/1976 Blauer ..... 2/2.5
4,079,464 A * 3/1978 Roggin ..... 2/2.5
5,060,314 A * 10/1991 Lewis ..... 2/2.5
5,331,683 A * 7/1994 Stone et al. ..... 2/2.5
5,903,920 A * 5/1999 Granqvist ..... 2/2.5

FOREIGN PATENT DOCUMENTS

FR 866 300 A 6/1941
GB 577 157 A 5/1946

* cited by examiner

*Primary Examiner*—Tejash Patel

(57) ABSTRACT

A protective waistcoat comprising a front section (3) on the front side of a person (1) wearing the waistcoat (2) and a back section (4) on the back side of said person, straps (5*a, b*; 14*a, b*; 20*a, b*; 21*a, b*; 25*a, b*; 29*a, b*, 31*a, b*) for connecting the two sections (2; 3), and a number of armor cover parts (6; 7*a, b*; 8*a, b*; 16*a, b*; 17; 18) forming the sections. The armor cover pars (16*a, b*; 17; 18) of the front section (3) furthermore comprises at least one upper plate-formed armor covert part (16*a, b*) for substantially covering the chest region of a person wearing the waistcoat and at least one lower plate-formed armor cover part (17; 18) for substantially covering the abdominal region of the person, and said armor cover parts are arranged in partly overlapping relationship to each other. The waistcoat according to the invention thereby offers the wearer much more freedom of movement and much more comfort than was available when using a protective waistcoat of conventional type.

14 Claims, 8 Drawing Sheets

PROTECTIVE WAISTCOAT

BACKGROUND OF THE INVENTION

1. Field of the Invention

The invention relates to a protective waistcoat which comprises a front section on the front side of a person wearing the waistcoat and a back section on the back side of said person, straps for connecting the two sections, and a number of armour cover parts forming the sections.

Personnel within, for example, the police and the army and also, for example, body guards and doormen can, in certain circumstances find themselves in dangerous situations where they risk being attacked by small arms such as revolvers and small machine guns or by pointed objects such as knives or awls.

When a person in such a situation is wearing a protective waistcoat, the person will, to a great extent, be secured against injury or even death by the attack.

2. Description of the Prior Art

Protective waistcoats have normally been made of materials that are resistant to penetration by projectiles fired from small arms. Some waistcoats have also been made of materials that are resistant to penetration by both a projectile and a pointed object such as a knife or an awl.

The material has conventionally been formed as plates that have been rather stiff and heavy to provide the person wearing the waistcoat the desired degree of protection.

While the known protective waistcoats made of such stiff and heavy armour plates could offer the wearer the desired degree of protection against attacks of the above named type, the problem of comfort and the impediments to mobility have been compromised.

U.S. Pat. No. 5,060,314 discloses a protective waistcoat comprising left and right combined front and side panels which are secured together by fastening means. U.S. Pat. No. 5,903,920 discloses a protective waistcoat made of various layers of woven fibres incorporating a net which is flexibly fixed relative to said layers.

SUMMARY OF THE INVENTION

The protective waistcoat of this invention, includes a front section and a back section wherein the front section comprises at least one upper plate-formed armour cover part for substantially covering the chest region of a person wearing the waistcoat, at least one lower plate-formed armour cover part for substantially covering the abdominal region of the person, and at least some of said armour cover parts are arranged in partly overlapping relationship to each other.

It is important that the various cover parts are arranged to partly overlap adjacent armour cover parts such that there are no openings that would allow a bullet or a knife or awl to pass through and hit the body of a wearer of the waistcoat.

DETAILED DESCRIPTION OF THE INVENTION

Figure 1:
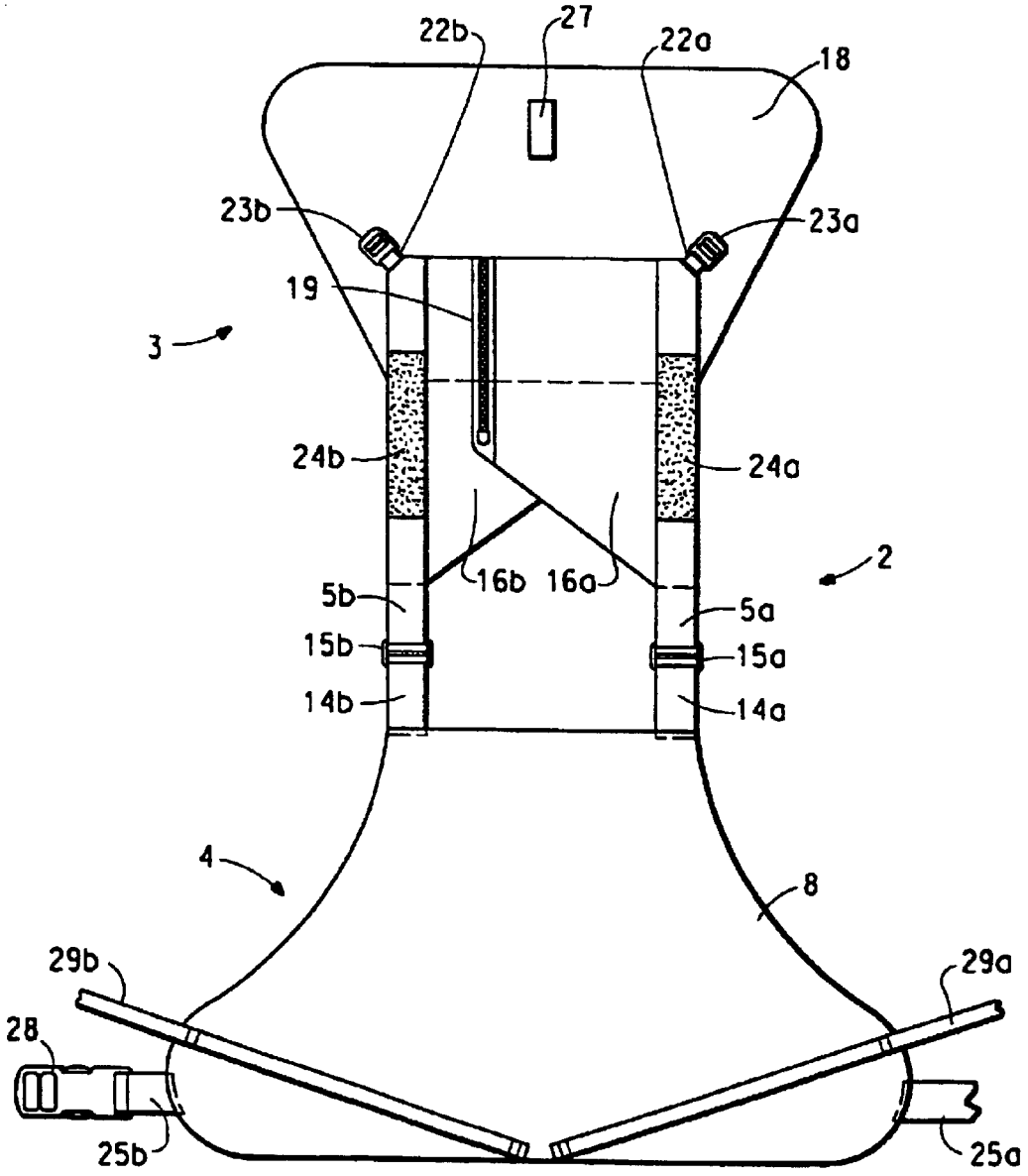
FIG. 1 shows, seen from the front, a first embodiment of the waistcoat according to the invention.

One object of this invention is to provide a protective waistcoat of the type mentioned, that is more comfortable for a person to wear than hitherto known.

Another object of this invention is to provide a protective waistcoat of the type mentioned, that provides the wearer with more mobility than hitherto known.

Another object of this invention is to provide a protective waistcoat of the type mentioned, that provides the wearer with both, protection against projectiles fired from small arms and against being stabbed by a pointed object such as a knife or an awl.

This design, including overlap of adjacent cover parts, provides a person wearing the waistcoat with a high degree of comfort and mobility in addition to a high degree of protection against being shot and/or stabbed.

Each armour cover part should comprise a fabric forming an enclosure, which is filled with a protective material; and the protective material should be resistant against penetration by low calibre projectiles fired from small arms. A suitable protective material for this purpose is para-aramid fiber such as that sold by E. I. du Pont de Nemours and Company under the trademark KEVLAR®. Such material exists typically in relatively thin layers of fabric, either woven or not, which are sewn or laid together to obtain the needed thickness.

Bullet-resistant materials are, however, often not sufficiently resistant against penetration by a pointed object like a knife or an awl. Between two layers of bullet-resistant materials, a second protective material can be placed, that is resistant to penetration by a knife or an awl. Such a material could be a plate of polycarbonate.

In a first and very simple embodiment of this invention the at least one upper plate-formed armour cover part for substantially covering the chest region of a person wearing the waistcoat comprises one upper plate-formed right hand armour cover part for substantially covering the right-hand chest region of a person wearing the waistcoat and at least one upper plate-formed left hand armour cover part for substantially covering the left-hand chest region of the person.

The right-hand—and left-hand upper armour cover parts can have a zipper or a similar device for assembling said parts in overlapping relationship to each other whereby the waistcoat is extremely easy to put on. Furthermore, the zipper ensures the maintenance of the required protective overlapping relationship. The waistcoat can be taken off in the same very easy manner.

To ensure that no part of the side of a wearer's torso is unprotected, the armour cover part of the back section can comprise at least one armour cover part arranged in partly overlapping relationship to the at least one lower plate-formed armour cover part of the front section when the waistcoat is positioned on the wearer.

Alternatively, the armour cover parts of the back section can comprise an elongated central armour cover part extending along the spinal column of a person wearing the waistcoat, and at least two plate-formed side armour cover parts attached at each side of the central armour cover part in partly overlapping relationship to this and to each other.

This construction is built up in a similar way as the skeleton of the human body, whereby the spinal column corresponds to the elongated central armour cover part and the ribs to the side armour cover parts. The waistcoat will, therefore, act in the same way as the skeleton by adapting to the movements of this, thereby offering a person wearing the waistcoat a high degree of comfort and mobility.

As for the first embodiment it is important to emphasize that the cover parts always are partly overlapping adjacent cover parts such that no openings can be found that allow a bullet or a knife or awl to pass and hit the body of the wearer.

The central armour cover part can have two armour cover webs at each side of the central armour cover part for partly overlapping the respective plate-formed side armour cover parts, that can be connected to the central armour cover part by means of connection webs; that, at each side of the central armour cover part, are placed between the two armour cover webs on the same side of the central armour cover part as the respective connection webs.

Movements of the skeleton of a wearer takes place by means of motor muscles, that, at their ends, are attached to the skeleton. The armour cover plates are, according to the invention, located such that they advantageously co-operate with the different groups of muscles by following their movement.

In a second embodiment of this invention, the armour cover plates can be arranged such that there are, at each side of the central armour cover part, an upper plate-formed side armour cover part for substantially covering the scapula region of a person wearing the waistcoat and a lower plate-formed side armour cover part for substantially covering the lower region of the back of the person; and that, at the front side of the person, there can be placed two upper plate-formed armour cover parts for substantially covering the chest region, and at least one lower-plate formed armour cover part for substantially covering the abdominal region of the person.

The various armour cover parts can be, according to the invention, connected with connecting means such as straps allowing the armour cover parts to move in relation to each other in such a way that the cover parts follow movements of the skeleton and the musculature of the person wearing the waistcoat.

For that purpose, the connecting means for interconnecting the front section and the back section, can have a first set of straps extending over the shoulders of a person wearing the waistcoat and connecting the upper plate-formed side armour cover parts for substantially covering the scapula region of the person and the at least one upper plate-formed armour cover part for substantially covering the chest region of the person.

Furthermore, that first set of straps can be connected to the upper end of the elongated central armour cover part extending along the spinal column of a person wearing the waistcoat by means of a second set of straps, and the lower end of the central armour cover part can be connected to the at least one upper plate-formed armour cover-part for substantially covering the chest region of the person by means of a third set of straps.

At least some of the straps can be made of an elastic material, to improve the possibility and ability of the armour cover parts to move in relation to each other and to follow the movements of the skeleton and the musculature of the person wearing the waistcoat.

As a matter of the design for the waistcoat of this invention, the weight of the waistcoat is distributed over the entire torso of the wearer. Consequently, the waistcoat does not feel heavy to wear.

Also, due to the specific construction of the waistcoat, it is very simple to adapt the waistcoat to different persons having different torso sizes and waist measurements.

Each armour cover part constitutes a releasable independent unit. Therefore, individual armour cover parts can be simply removed from the waistcoat and replaced by a new intact armour cover part. Furthermore, armour cover parts for any individual need can easily be manufactured. For example, it can be mentioned that the upper plate-formed armour cover part can be designed to perfectly fit a woman.

The invention will be explained more fully by the following description of an embodiment, which just serves as an example, with reference to the drawings.

Figure 2:
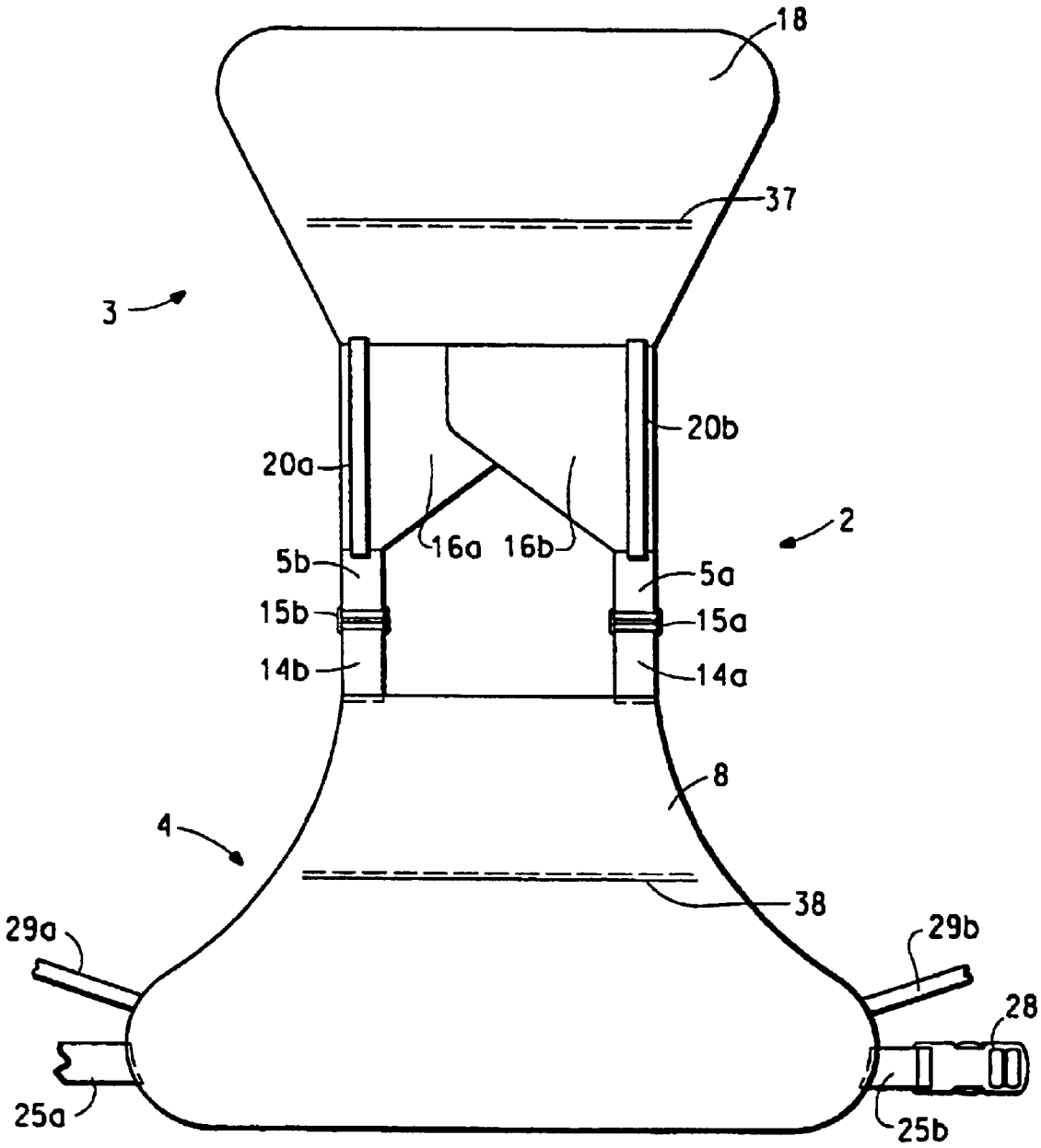
FIG. 2 shows the same, seen from behind.

FIG. 1 is, seen from the front, a first embodiment of a waistcoat according to the invention. FIG. 2 shows this embodiment from behind. Waistcoat 2 consists of a front section 3 and a back section 4. The two sections 3 and 4 are arranged to partly overlap each other along the side of the person wearing the waistcoat thereby carefully protecting also this part of the person. Shoulder straps 5*a*,5*b*, extending over the shoulders of the person, are connecting means for connecting the two sections 3 and 4.

The waistcoat 2 shown in FIGS. 1 and 2 is a four-unit waistcoat in which section 4 is one single armour cover part 8 and section 3 is built up of three armour cover parts 16*a*,16*b*,18 in partly overlapping relationship. The upper plate-formed armour cover parts 16*a*,16*b* are detachably assembled in partly overlapping relationship to each other by means 19 which, in the shown case, is a zipper 19.

Two straps 14*a,b* are attached to the top of the armour cover part 8 of the back section 3 for connecting said armour cover part 8 to the upper plate-formed armour cover parts 16*a*,16*b* of the front section 3 by means of the shoulder straps 5*a,b* extending over the shoulders of the person wearing the waistcoat. Buckles 15*a,b* serve for making the connections adjustable.

The two sections 3 and 4 are brought into correct position in relation to the body of the person and to each other by adjusting the shoulder straps 5*a,b* in relation to the upper cover parts 16*a,b*. This adjusting can be done easily and quickly because the upper cover parts 16*a,b* and the shoulder straps 5*a,b* are supplied with connecting means such as, for example, mating strips of hook and pile fastening known as VELCRO® 24*a,b*.

The lower cover part 18 is connected to the shoulder straps 5*a,b* by means of straps 20*a,b* made of an elastic material.

There can, also, be provided one or more straps, for connecting either the lower end of the lower plate-formed armour cover part 18 of front section 3 and/or the lower end of the armour cover part 8 to the belt straps of the trousers (not shown) of the person wearing the waistcoat.

One pair of straps 25*a,b,* attached to each side of the lower end of the armour cover part B of the back section 4, are pulled through a loop 27 on the lower plate-formed armour cover part 18 of the front section 3 and the straps 25*a,b* are adjustably tightened in relation to each other by means of a buckle 28.

The lower end of the plate-formed armour cover part 8 of the back section 4 and the lower end of the plate-formed armour cover part 18 of the front section 3 are partly folded over the side regions of the body of the person wearing the waistcoat in partly overlapping relationship to each other while in the same time said parts are gathered around the body.

Two other straps 29*a,b* can be attached to each side of the lower end of the plate-formed armour cover part 8 of the back section 4 for connecting the upper plate-formed armour cover parts 16*a,b* of the front section 3 to armour cover part 8. The straps 29*a,b* are fixed to buckles 23*a,b* on the upper plate-formed cover parts 16*a,b,* said buckles being attached to said cover parts 16*a,b* by means of straps 22*a,b*.

During tightening and adjusting of straps 29*a,b* the lower cover part 8 of the back section 4 and the lower plate-formed cover part 18 of the front section 3 are caused to gather around the body of the wearer. Adjustment of the fitting of the waistcoat to the person is described in further detail in relation to the second embodiment.

However, by a simple individual adjustment of the strap system of the waistcoat, the waistcoat can be made to perfectly fit the torso of a person; and, because the straps are made of an elastic material, the movement of the person will not affect the correct protective placement of the cover parts of the waistcoat.

This first embodiment is preferably made as a lightweight waistcoat in which one or more of the armour cover parts are made up of several layers of a first protective material, such as KEVLAR® aramid fiber, and at least one layer of a second protective material such as polycarbonate. Other combinations and numbers of material are foreseen within the scope of the invention. This lightweight embodiment is comfortable to wear and is often the preferred choice of persons such as doormen at discothéques and bodyguards, who at the same time, must wear a jacket outside the waistcoat in order to have a presentable appearance.

In consideration of a second embodiment, the armour cover parts are manufactured in the same manner using the same materials as described previously. A detailed description of the different body areas protected by the different cover parts follows in relation to that second embodiment.

Each armour cover part has an outside fabric covering in the form of an enclosure. In the embodiment shown in FIGS. 1 and 2, the enclosures are as an example made with openings 37,38 through which a protecting material can be inserted and removed.

Figure 3:
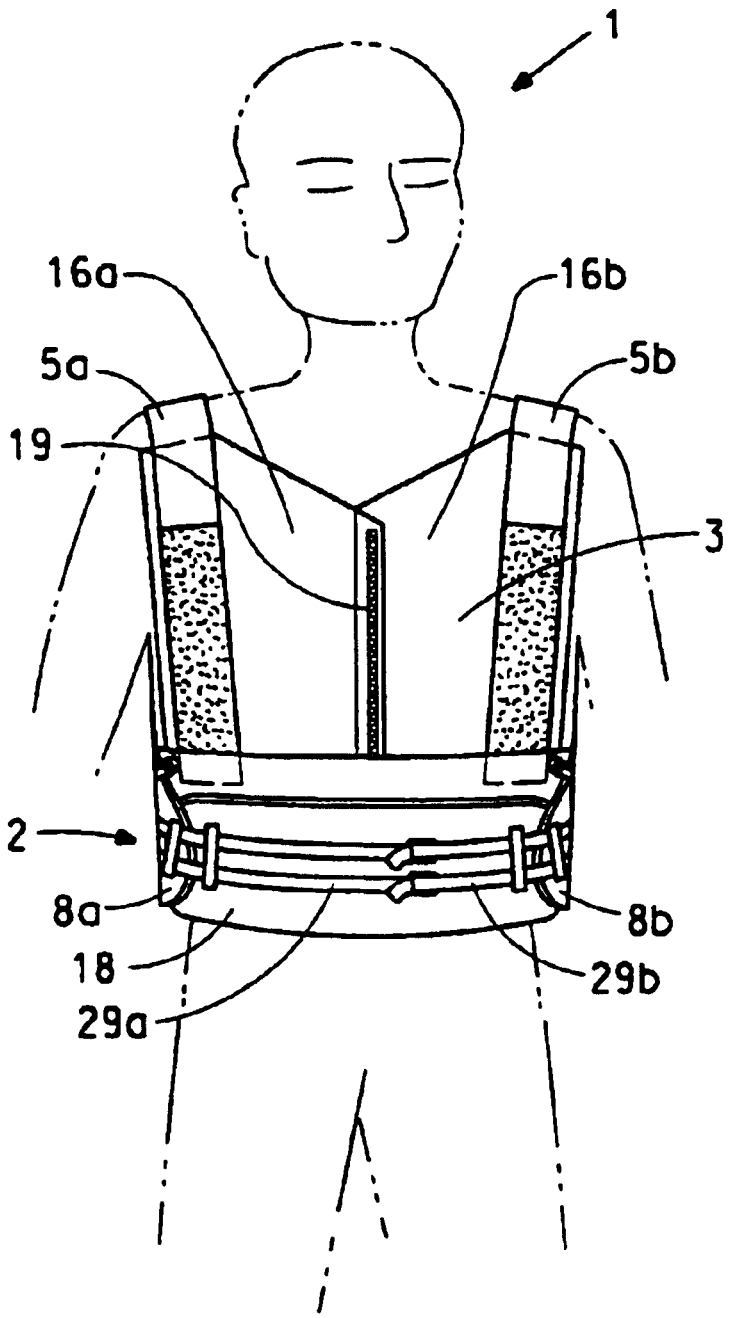
FIG. 3 is a front view of a person wearing a second embodiment of a waistcoat according to the invention.
Figure 5:
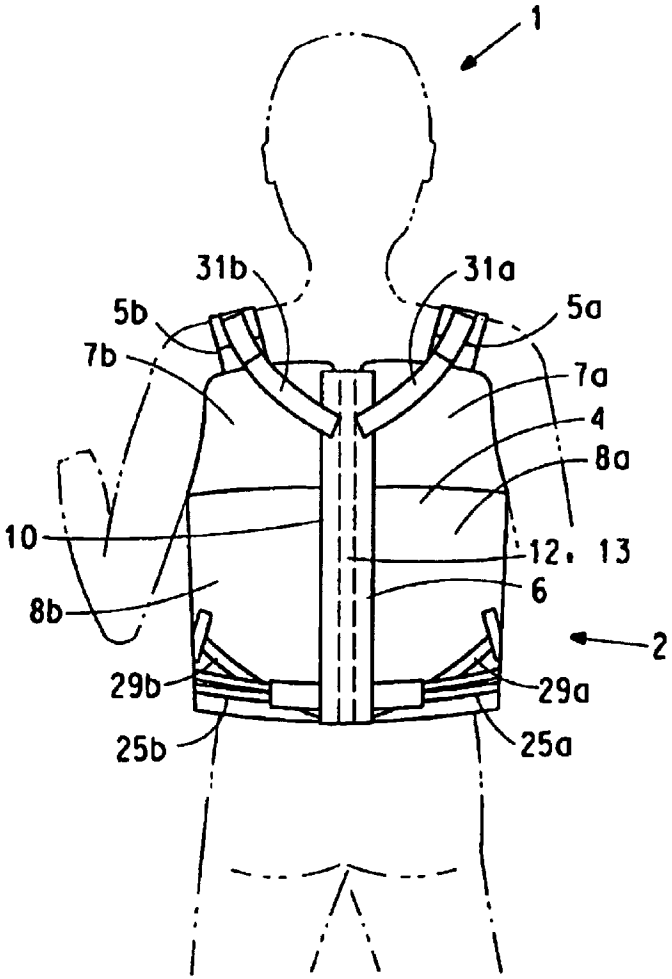
FIG. 5 shows the same, seen from behind.
Figure 4:
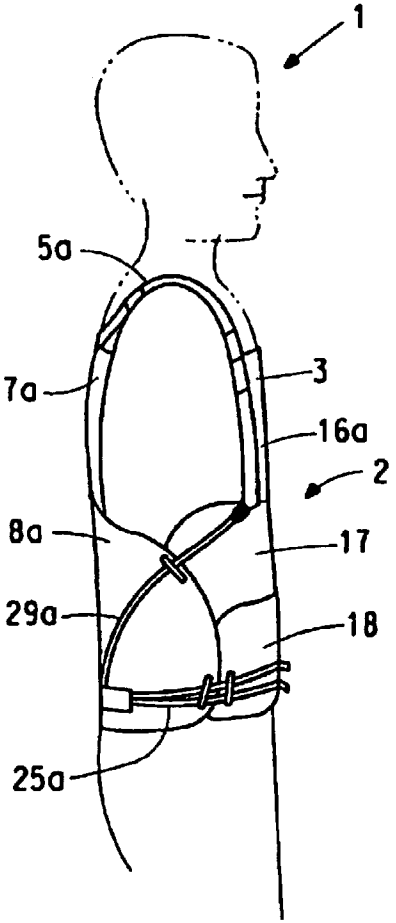
FIG. 4 shows the same, seen from the side.

In FIGS. 3–5 is seen a person 1 wearing a second embodiment of a waistcoat 2 according to the invention. This embodiment of the waistcoat provides very high protection against low calibre projectiles fired from small arms such as revolvers and small machine guns and/or against pointed objects such as a knife or an awl.

The waistcoat according to this second embodiment of the invention consists of a front section 3, as seen in FIG. 3, and a back section 4, as seen in FIG. 5. FIG. 4 shows that the two sections 3 and 4 are partly overlapping each other along the side of the person thereby carefully protecting also this part of the person. Shoulder straps 5*a*,5*b*, extending over the shoulders of the person, are connecting the two sections 3 and 4.

Figure 6:
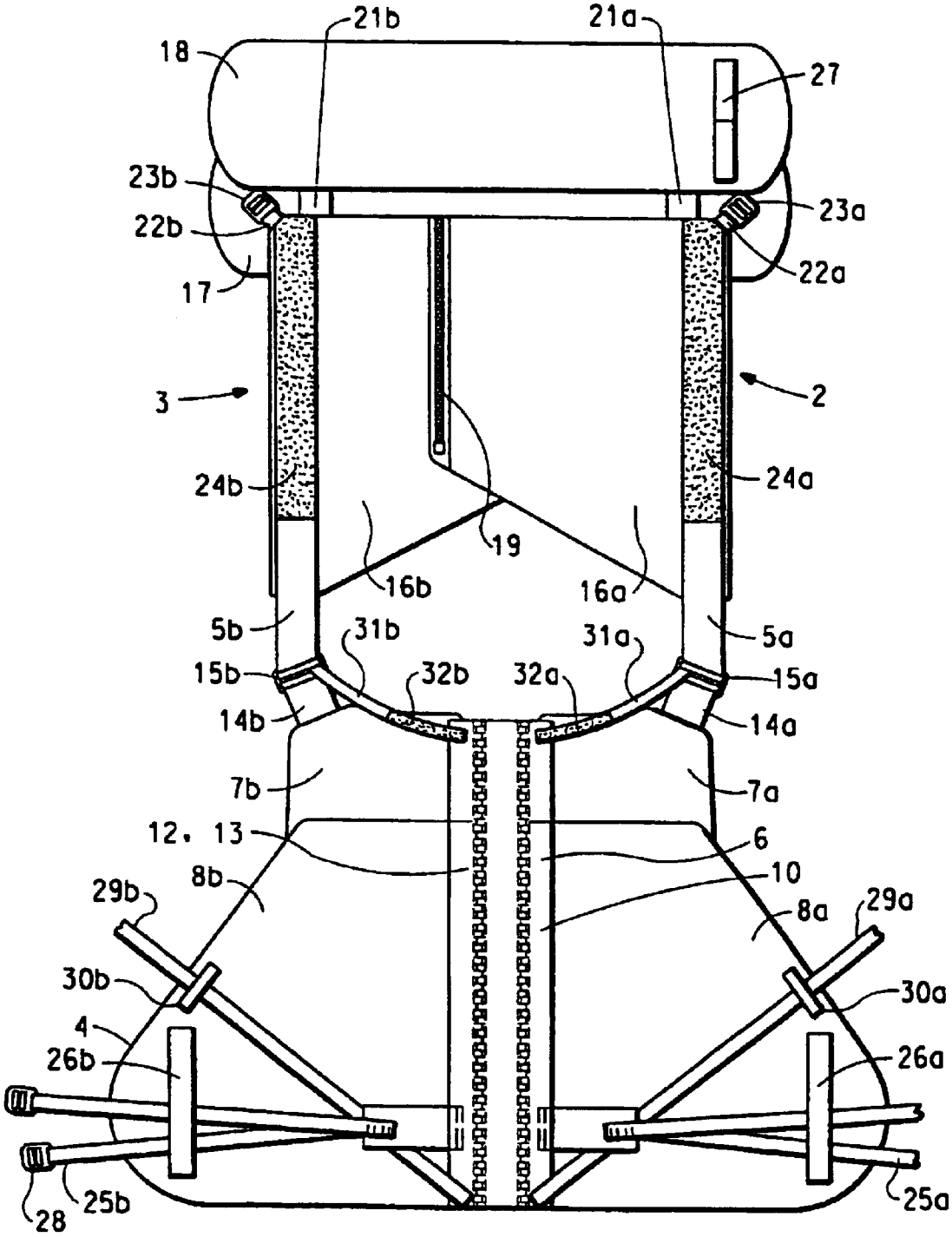
FIG. 6 shows, on an enlarged scale, the second embodiment of the waistcoat, seen from the front.
Figure 7:
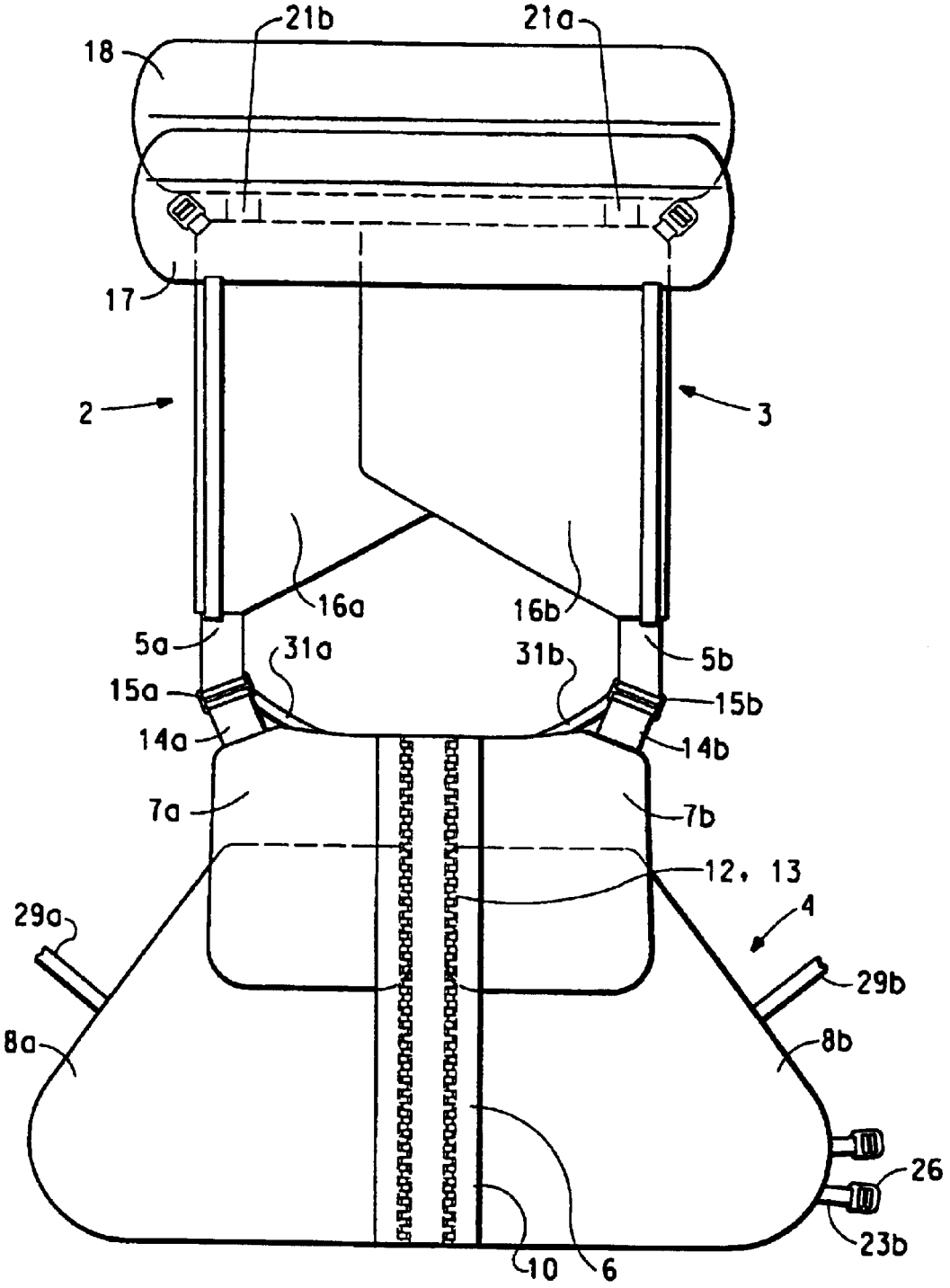
FIG. 7 shows the same, seen from behind.

FIGS. 6 and 7 show, an an enlarged scale, solely the waistcoat 2, which, in FIG. 6, is seen from the front and, in FIG. 7, from behind. The two sections 3 and 4 are built up of several armour cover parts, the construction of which will be more fully explained later on.

The cover parts of the back section 4 consist of an elongated central cover part 6 extending along the spinal column of the person 1, two upper plate-formed side cover parts 7*a,b* and two lower plate-formed side cover parts 8*a,b*.

Figure 8:
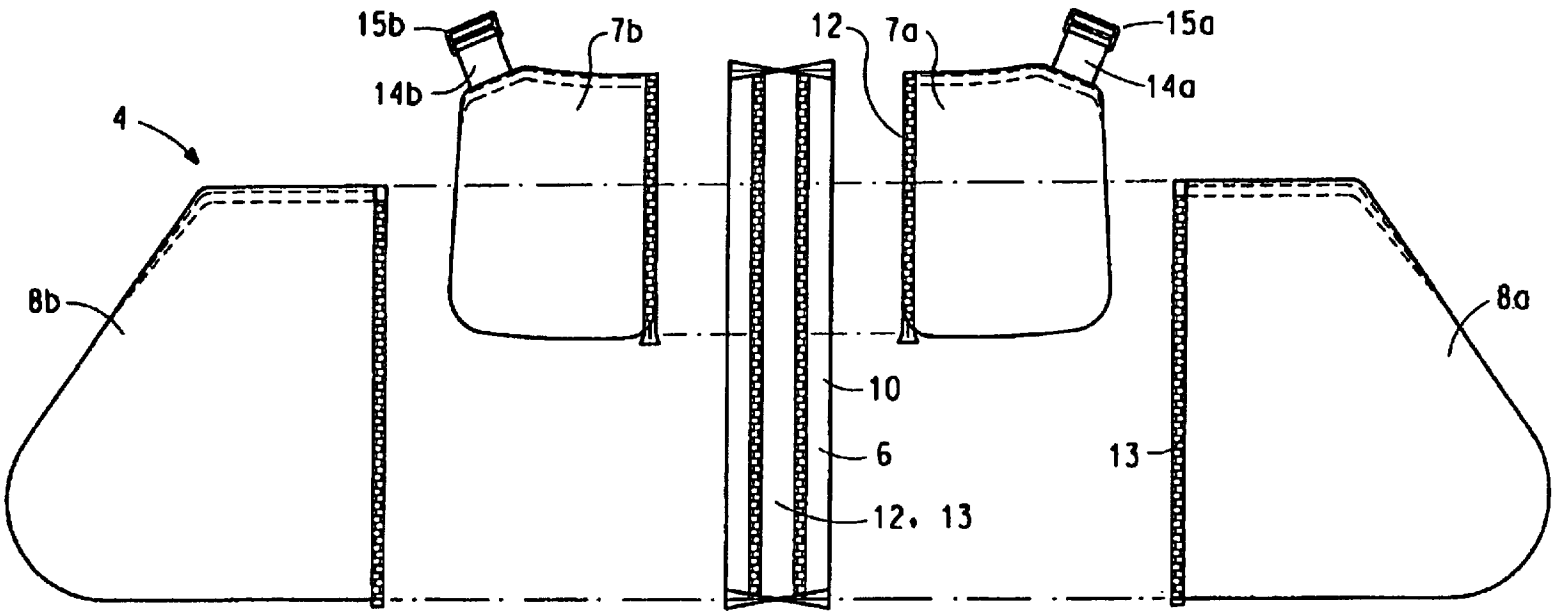
FIG. 8 is an exploded view of a back section of the second embodiment of the waistcoat.
Figure 9:
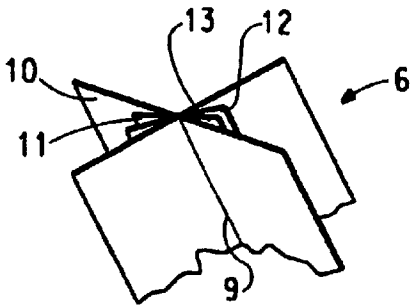
FIG. 9 is a perspective view of a fragment of an elongated central armour cover part of the back section of the second embodiment.

The back section of the waistcoat is in FIG. 8, seen in an exploded view, and the central cover part 6 is, in perspective, shown in FIG. 9.

As best seen in FIG. 9, the central cover part 6 has at each side of a central axis 9, two armour cover webs 10 and two connection webs 11 which are placed between two of said armour cover webs 10.

Each of the upper plate-formed side cover parts 7*a,b* is assembled with one of the connection webs 11 by means of a zipper 12, and each of the lower plate formed side cover parts 8*a,b* is assembled with another one of the connection webs by means of a zipper 13.

When attached to the connection webs 11, the armour cover webs 10 are partly overlapping the cover parts 7*a,b* and 8*a,b*, and these are again partly overlapping each other.

Two straps 14*a,b* are attached to the top of the two upper side cover parts 7*a,b* for connecting said parts to the front section by means of shoulder straps 5*a,b* extending over the shoulders of the person wearing the waistcoat. Buckles 15*a,b* serve for making the connections adjustable.

The cover parts of the front section 3 consist of two upper plate-formed cover parts 16*a,b* and a first 17 and second 18 lower plate-formed cover part. The upper cover parts 16*a,b* is in this case detachably assembled by means of a zipper 19 in partly overlapping relationship to each other.

The first lower cover part 17 is connected to the upper plate-formed cover parts 16*a,b* in partly overlapping relationship to this by means of straps 20*a,b* attached to the upper end of the upper cover parts 16*a,b*. The straps are preferably made of an elastic material such as neoprene.

The second lower cover part 18 is connected to the upper plate-formed cover parts 16*a,b* in partly overlapping relationship to the first lower cover part 17 by means of straps 21*a,b* attached to the lower end of the upper cover parts 16*a,b*. The straps 21*a,b* are preferably made of an elastic material such as neoprene.

Furthermore, there can be provided one or more straps, for connecting either the lower end of the first lower plate formed cover part 17 of front section 3 or the lower end of the second lower plate formed cover part 16 of front section 3 to the belt straps of the trousers (not shown) of the person wearing the waistcoat. Optionally a corresponding arrangement can be made in relation to the back section 4.

Straps 22*a,b* having buckles 23*a,b* attached to the lower end of the upper cover parts 16*a,b* serve to connect these to the belt straps of the trousers (not shown) of the person wearing the waistcoat.

When putting on the waistcoat, the shoulder straps 5*a,b*, which connect the front and back sections 3 and 4 of the waistcoat 2, are laid over the shoulders of the person who is to wear the waistcoat, such that the front section is hanging down the front of the person and the back section is hanging down the back of the person.

The two sections 3 and 4 are brought into correct position in relation to the body of the person and to each other by adjusting the shoulder straps 5*a,b* in relation to the upper cover parts 16*a,b*. This adjusting can be done easily and quickly because the upper cover parts 16*a,b* and the shoulder straps 5*a,b* are supplied with mating strips of hook and pile fastening known as VELCRO® 24*a,b*.

The two sections 3 and 4 are, then, tightened in relation to the body of the person and in relation to each other by means of several straps.

Two pair of straps 25*a,b*, attached to each side of the lower end of the central cover part 6 of the back section 4, are pulled through loops 26*a,b* on the lower plate-formed side cover parts 8*a,b* of the back section 4 and through another loop 27 on the second lower plate-formed cover part 18 of the front region 3. Then the two pair of straps 25*a,b* are tightened in relation to each other by means of buckles 28 on one of the two pair of straps 25*a,b*. The lower plate-formed side cover part 8*a,b* of the back section 4 and the second lower plate-formed cover part 18 of the front region 3 are thereby partly folded over the side regions of the body of the person 1 in partly overlapping relationship to each other while, at the same time, said parts are gathered about the body.

Further, two other straps 29*a,b*, attached to each side of the lower end of the central cover part 6 of the back section 4, are pulled through loops 30*a,b* on the lower plate-formed side cover parts 8*a,b* of the back section 4 and fastened to the lower end of the upper plate-formed cover part 16*a,b* of the front section 3, thereby gathering the lower plate formed side cover parts 8*a,b*, the first lower plate-formed cover part 17 of the front region 3, and the upper plate-formed cover parts 16*a,b* of the front section 3 about the body of the wearer.

At the same time the first cover part 17 is brought into partly overlapping relationship with the lower plate-formed side cover parts 8*a,b* of the back section 4 and into the upper plate-formed cover parts 16*a,b* of the front section 3. The first cover part 17 has also been partly folded around the side region of the body of the wearer.

Two straps 31*a,b* attached to each side of the upper end of the elongated central cover part 6 of the back section 4 are pulled through the buckles 15*a,b* on the straps 14*a,b* on top of the upper side cover parts 7*a,b* for centralising the back section in relation to the body of the wearer.

This operation can be done easily and quickly by supplying the straps 31*a,b* with strips 32*a,b* of hook and pile fastening known as VELCRO®.

Also the upper cover parts 16*a,b* of the front section 2 of the waistcoat are attached to the belt straps of the person's trousers (not shown) by means of the straps 22*a,b* with the buckles 23*a,b*.

Now the waistcoat is carefully secured to the body of the wearer in such a way that the armour cover parts are partly overlapping the adjacent cover parts, thereby leaving no opening for allowing a bullet or a knife or awl to find its way to the body of the wearer.

Figure 10:
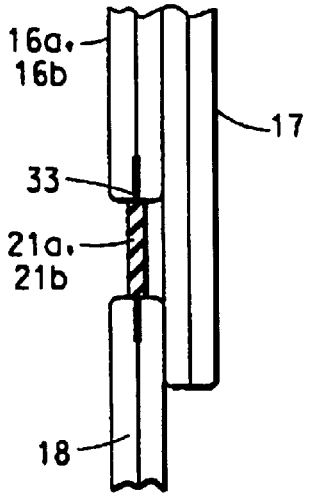
FIG. 10 shows a fragment, seen from the side, of the lower end of a front section of the second embodiment of the waistcoat.

This advantageous construction is illustrated in FIG. 10 showing a fragment, seen in section, of the lower end of the front section 2. The upper plate-formed cover part 16*a,b* of the front section 2 is, as can be seen, connected to the second lower plate-formed cover part 18 of the front region 2 with the straps 21*a,b* leaving an opening 33 free between said parts. Said opening is, however, covered by the first lower plate-formed cover part 17.

Figure 12:
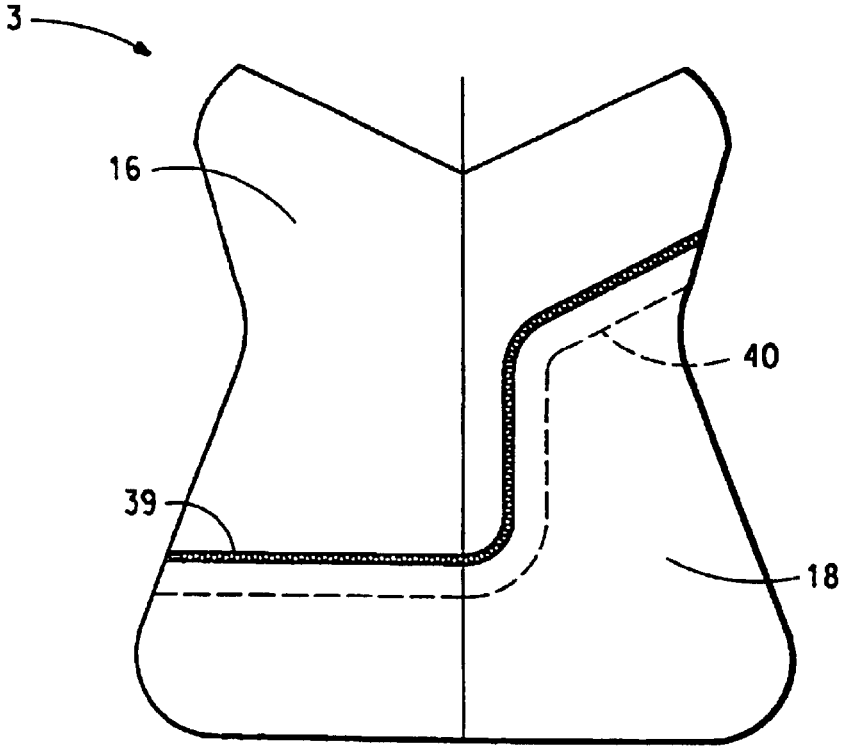
FIG. 12 shows, in simplified form, another embodiment of the front section of the invention.

FIG. 12 shows another embodiment of the invention as it can be applied to the front section 3 of the waistcoat. In FIG. 12, front section 3 includes one upper plate-formed armour cover part 16 and one lower plate-formed armour cover part 18 joined by connecting means 39, a zipper, for example. Upper cover part 16 is overlapped with lower cover part 18. The edge 40 of upper cover part 16 shows the degree of overlap.

Connecting means 39 is joined to upper cover part 16 and lower cover part 18 in such a manner that the cover parts 16,18 can move relative to each other with movement of the wearer of a waistcoat that includes this front section 3. The path of connecting means 39 and of the edges of the cover parts 16,18 can follow a diagonal down from the right or the left side, or can take the shape of an "S" (as in FIG. 12) or the shape of a "Z", or can be a combination of horizontal and vertical runs in any way such that the cover parts 16,18 can move relative to each other.

Figure 11:
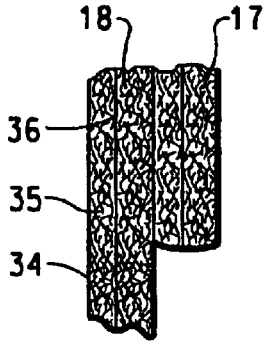
FIG. 11 shows on an enlarged scale, seen in section, a detail of the lower end of the front section of the second embodiment of the waistcoat.

FIG. 11 shows, on an enlarged scale and seen in section, a detail of the two lower cover parts 17 and 18 illustrating how the armour cover parts more precisely are constructed.

Each armour cover part comprises a fabric covering in the form of an enclosure 34. In the enclosure is placed a first protecting material 35, which is resistant against being penetrated by low calibre ballistic projectiles.

The first protecting material could be KEVLAR® aramid fiber, a material that is made by E. I. du Pont de Nemours and Company and formed into thin layers of fabric that can be sewn together to obtain the necessary thickness.

Many bullet-resistant materials are, however, not sufficiently effective against being penetrated by a pointed object such as a knife or an awl. To overcome this problem there can be, between two layers of the first protecting material 35 in each enclosure, a second protecting material 36 which is resistant against penetration by a knife or an awl. The second protecting material 36 could typically be a plate of a hard plastic such as polycarbonate.

As it appears from the explanation above, the armour cover parts each correspond to a specific region of the body of the person wearing the waistcoat. Moreover, the straps connecting the armour cover parts are to a great extent arranged along the motor muscles and also have such an elasticity that each armour cover part follows the movement of the corresponding region of the body.

The waistcoat according to the invention therefore obtains the same pattern of movement as the body of the person wearing the waistcoat, thereby offering the person much more freedom of movement and much more comfort than is possible when using a protective waistcoat of conventional type.

More specifically, the upper armour cover parts 16*a,b* of the front section 2 covering the chest sit tightly to follow the body movement, while the lower armour cover parts 17 and 18 of the front section 2 slide over each other like tiles for no impediment to body movement or downward rotation of body.

The lowermost armour cover part 18 is fastened to the belt straps on the person's trousers (not shown) ensuring that it remains in position when moving away from a potential attacker forcing the person backwards.

The upper plate-formed side cover parts 7*a,b* of the back section 3 are constructed to slide, stretch from the connections, and fall back into place depending on how the body moves, and the lower plate-formed cover parts 8*a,b* overlaps the abdominal region.

The waistcoat according to the invention provides the wearer with a great mobility. The waistcoat enables the wearer to sit, to get in and out of a vehicle, without the protective parts of the waistcoat being moved out of a protective position. The waistcoat fits tightly over the human body and will, due to its structure, always adapt to the different movements of the person. A person raising his arms to a shooting position will still be protected as the cover parts during the movement of the arms slide over each other. The known rigid protective waistcoats are raised together with the arms thereby providing an unpractical and cumbersome shooting position, in addition to exposing a part of the wearer's body.

The embodiments described above and shown in the figures are only to be understood as examples of the invention. Within the scope of the invention there can be many other embodiments. As an example can be mentioned that the waistcoat can be made with the front according to the invention and a traditional back.

The front section of the waistcoat can, by way of example, be formed like the back section with an elongated central cover part and plate-formed side cover parts attached to the central cover part.

Furthermore, each of the cover parts can be removed and washed individually, if they were to get soiled.

The foregoing description of the present invention has been presented for the purpose of illustration and description. The description is not intended to limit the invention to the form disclosed herein. Consequently, variations and modifications commensurate with the above teaching and the skill or knowledge of the relevant art are within the scope of the invention. The embodiments described herein are further intended to explain best mode known for practising the invention. It is intended that the appended claims be construed to include alternative embodiments to the extent by the prior art.

What is claimed is:

1. A protective waistcoat comprising a front section and a back section and connecting means for connecting the two sections characterised in that the front section comprises at least one upper plate-formed armour cover part for substantially covering the chest region of a person wearing the waistcoat, at least one lower plate-formed armour cover part for substantially covering the abdominal region of the person, and that at least one of said upper plate formed armour cover parts is arranged in partly overlapping relationship to at least one of said lower plate-formed armour cover parts to allow a sliding relationship.

2. A protective waistcoat according to claim 1, characterised in that the at least one upper plate-formed armour cover part for substantially covering the chest region of a person wearing the waistcoat comprises, at least one upper plate-formed right hand armour cover part for substantially covering the right-hand chest region of a person wearing the waistcoat, and at least one upper plate-formed left hand armour cover part for substantially covering the left-hand chest region of the person.

3. A protective waistcoat comprising a front section and a back section and connecting means for connecting the two sections characterised in that the front section comprises at least one upper plate-formed armour cover part for substantially covering the chest region of a person wearing the waistcoat, at least one lower plate-formed armour cover part for substantially covering the abdominal region of the person, and that at least some of said armour cover parts are arranged in partly overlapping relationship to each other so as to allow said parts to slide over each other, further characterised in that the right hand and left hand upper armour cover parts are arranged in partly overlapping relationship to each other.

4. A protective waistcoat according to claim 1 or 2, characterised in that the back section comprises at least one armour cover part arranged in partly overlapping relationship to the at least one lower plate-formed armour cover part of the front section when the waistcoat is positioned on a person.

5. A protective waistcoat comprising a front section and a back section and connecting means for connecting the two sections characterised in that the front section comprises at least one upper plate-formed armour cover part for substantially covering the chest region of a person wearing the waistcoat, at least one lower plate-formed armour cover part for substantially covering the abdominal region of the person, and that at least some of said armour cover parts are arranged in partly overlapping relationship to each other so as to allow said parts to slide over each other, further characterised in that the back section comprises an elongated central armour cover part extending along the spinal column of a person wearing the waistcoat, and at least two plate-formed side armour cover parts attached on each side of the central armour cover part in partly overlapping relationship.

6. A protective waistcoat according to claim 5, characterised in that the central armour cover part comprises at least two webs extending in opposite directions and connecting the at least two plate-formed side armour cover parts on each side of the central armour cover part, and at least two armour cover webs extending in opposite directions and partly overlapping the at least two plate-formed side armour cover parts connected to the respective connection web.

7. A protective waistcoat according to claim 5 or 6, characterised in that the central armour cover part comprises two armour cover webs on each side of the central armour cover part, and two connection webs on each side of the central armour cover part arranged between the two armour cover webs placed on the same side of the central armour cover part as the respective connection webs.

8. A protective waistcoat according to claim 5 or 6, characterised in that there is arranged an upper plate-formed side armour cover part on each side of the central armour cover part for substantially covering the scapula region of a person wearing the waistcoat; and there is arranged a lower plate-formed side armour cover part on each side of the central amour cover part for substantially covering the lower region of the back of the person.

9. A protective waistcoat according to claim 1, 2, 5, or 6 characterised in that each armour cover part comprises a fabric lining forming an enclosure, and a first protecting, material, that is held in said enclosure and is ballistic resistant.

10. A protective waistcoat according to claim 9, characterised in that the first protecting material in the enclosure comprises a plurality of layers sewn together.

11. A protective waistcoat according to claim 10, characterised in that, between layers of the first protecting material in the enclosure, there is placed at least one second protecting material that is resistant to penetration by a knife or an awl.

12. A protective waistcoat according to claim 5 or 6, characterised in that the connecting means for connecting the front section and the back section of the waistcoat comprise a first set of straps extending over the shoulders of a person wearing the waistcoat and connecting the upper plate-formed side armour cover parts for substantially covering the scapula region of the person with at least one upper plate-formed armour cover part for substantially covering the chest region of the person.

13. A protective waistcoat according to claim 12, characterised in that the first set of straps is connected to the upper end of the elongated central armour cover part extending along the spinal column of a person wearing the waistcoat by means of a second set of straps, and the lower end of the central armour cover part is connected with the at least one upper plate-formed armour cover part for substantially covering the chest region of the person by means of a third set of straps.

14. A protective waistcoat according to claim 13, characterised in that at least some of the straps are made of an elastic material.

* * * * *